US006154175A

United States Patent [19]

Yee

[11] Patent Number: 6,154,175

[45] Date of Patent: Nov. 28, 2000

[54] WIDEBAND MICROSTRIP ANTENNA

[75] Inventor: James S. Yee, Seattle, Wash.

[73] Assignee: The Boeing Company, Seattle, Wash.

[21] Appl. No.: 06/360,310

[22] Filed: Mar. 22, 1982

[51] Int. Cl.[7] ..... H01Q 3/02

[52] U.S. Cl. ..... 343/700 MS; 343/753; 343/785; 343/911 R

[58] Field of Search ..... 343/700 MS, 705, 343/753, 708, 785, 911 R

[56] References Cited

U.S. PATENT DOCUMENTS 4,053,895 10/1977 Malagisi ..... 343/700 MS 4,125,839 11/1978 Kaloi ..... 343/700 MS 4,329,689 5/1982 Yee ..... 343/700 MS

*Primary Examiner*—Theodore M. Blum

*Attorney, Agent, or Firm*—John C. Hammar

[57] ABSTRACT

A wideband antenna element includes a conductive plate parallel to, and spaced from a ground plane. A tapered dielectric material is positioned between the plate and ground plane. A pair of driving points to the plate are positioned fixed distances on either side of a center interconnect point between the plate and ground plane, to effect staggered tuning of the antenna element.

5 Claims, 1 Drawing Sheet

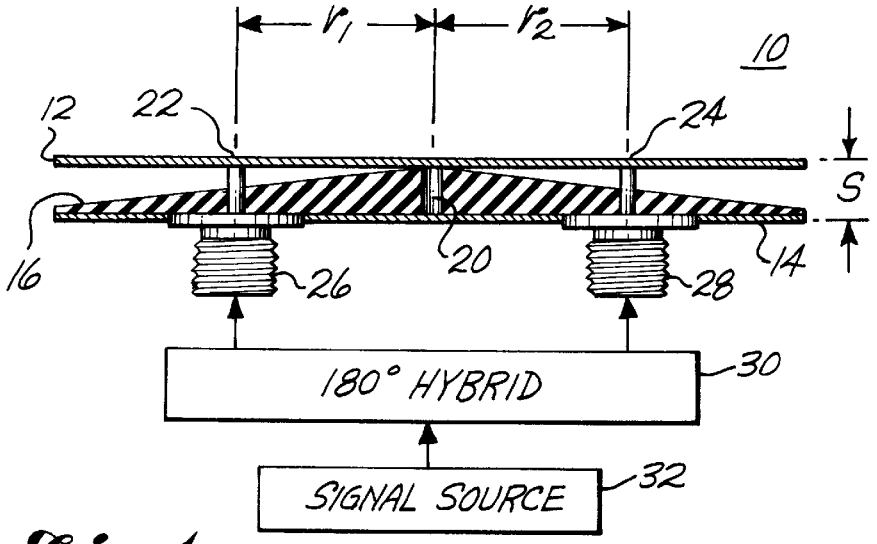
Fig. 1
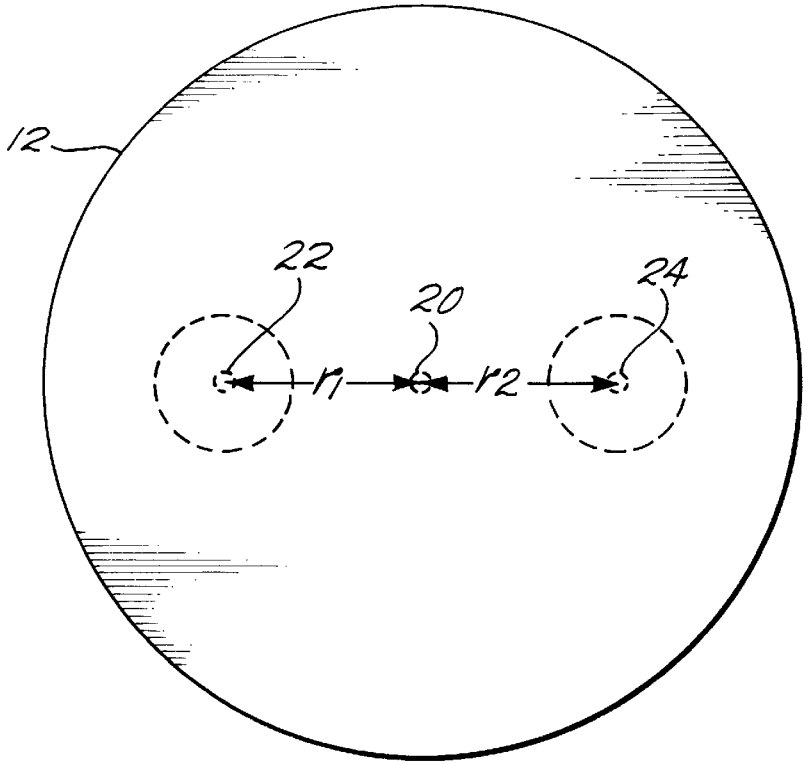
Fig. 2
Fig. 3
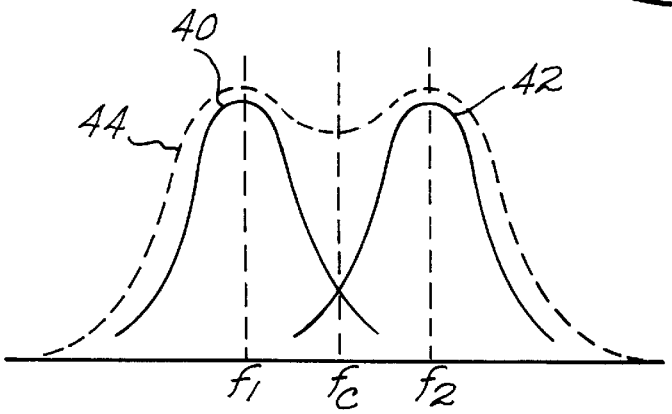

WIDEBAND MICROSTRIP ANTENNA

BACKGROUND OF THE INVENTION

The present invention pertains to the electromagnetic radiation art and, more particularly, to a wideband microstrip antenna.

Microstrip radiating elements are well-known in the antenna art. A microstrip antenna is generally comprised of a pair of thin parallel plates, one acting as a driven element and the other, as a continuous ground plane. These plates are separated by a dielectric material. The dimension of the driven plate is selected to resonate at the frequency of interest.

Compared with other antenna elements such as dipoles and slotted radiators, microstrip antennas are economical to design and construct, rugged, compact, lightweight, low-profile and can be made conformal and integrated into typical body structures of, for example, military airplanes. A fundamental failing of microstrip antennas known to the prior art has been their limited bandwidth. This restriction has severely limited the utility of microstrip antenna elements.

SUMMARY OF THE INVENTION

It is an object of this invention, therefore, to provide a microstrip antenna element which exhibits a wide bandwidth.

Briefly, according to the invention, a microstrip antenna comprises a conductive element ground plane and a predetermined dimension conductive plate (patch) which is predeterminedly spaced from the ground plane. A tapered dielectric element is positioned between the conductive plate and the ground plane. Electrical interconnection between the conductive plate and the ground plane is made at a predetermined point. A pair of driving point connections are made to the conductive plate, with each being at a predetermined distance from the interconnection point.

BRIEF DESCRIPTION OF THE DRAWINGS

FIG. 1 is a cross-sectional view of the preferred embodiment of a wideband microstrip antenna element;

FIG. 2 is a top view of the microstrip antenna element shown in FIG. 1; and FIG. 3 is a frequency response plot of the microstrip element shown in FIGS. 1 and 2.

DETAILED DESCRIPTION OF THE PREFERRED EMBODIMENT OF THE INVENTION

FIG. 1 is a cross-sectional view of the preferred embodiment of the microstrip antenna, indicated generally at 10. The element is comprised of a driven conductive plate 12 which is spaced a predetermined distance s from a conductive ground plane 14. Positioned between the plate 12 and ground plane 14 is a tapered dielectric substrate 16. In this, the preferred embodiment of the invention, the conductive plate 12 and ground plane 14 are circular, whereby the dielectric substrate 16 is conical in shape. A grounding pin 20 electrically interconnects the ground plane 14 and driven plate 12 through the dielectric substrate 16.

The plate 12 is driven at two points 22, 24, each of which is spaced a predetermined distance $r_1$, $r_2$, respectively, from the grounding pin 20. Conventional coaxial connectors 26, 28 provide a means for connecting to the ground plane 14 and the driven points 22, 24. These points are, in turn, connected to a 180° hybrid 30 which, in the normal manner, separates the signal, such as from a signal source 32, into two equal amplitude, 180° out of phase signals. It is these out of phase signals which drive the points 22, 24.

Since 180° hybrid circuits are well-known to this art, no detailed discussion of their construction is given herein.

FIG. 2 is a top view of the conductive plate 12 shown in FIG. 1. Here, the conductive plate 12 is circular in shape and is configured to resonate at the frequencies of interest. The driving points 22, 24 are located on the same diameter of the plate 12, which diameter extends through the center of the circular plate and, thus, through the point at which the grounding pin 20 connects with the plate 12. As shown, the driving points are located at predetermined distances $r_1$, $r_2$, respectively, from the grounding pin 20.

Operation of the antenna element shown in FIGS. 1 and 2 is understood as follows. The antenna element configuration shown operates basically in a $TM_{010}$ mode, where TM stands for "transverse magnetic". The 1 in the subscript designates a full cycle cosinusoidal angular variation of the field structure inside of the cavity. The first zero indicates that the field varies in the radial direction as $J_0$ (KR), where $J_0$ is the Bessel function of the zeroth order, K is a wave constant and P represents radius. The second zero indicates that the field is constant between the driven plate 12 and the ground plane 14.

As a result of the cosinusoidal angular variation in field, points directly opposite each other from the center grounding pin will have equal, but 180° out of phase fields. Hence, the conductive plate may be driven at two driving points, without perturbation to the proper field structure, as long as the driving points are symmetrically located about the grounding point and as long as there is a 180° phase relationship between the signals applied to the driving points. Thus, by driving the cavity at two balanced points, mode symmetry is preserved and a means for enhancing bandwidth presents itself, namely, staggered tuning.

The resonant frequency of the microstrip element is primarily determined by the diameter of the conductive plate 12. It is also functionally related to the distance of the driving point from the grounding point. This offset distance, r, determines the match between the impedance of the driving element and that of the microstrip element. Thus, by proper selection of the distances $r_1$ and $r_2$, good impedance match can be achieved at two closely spaced frequencies, $f_1$ and $f_2$, centering about the resonant frequency fc. This is shown graphically in FIG. 3. Here, the frequency response plot of the microstrip element, as a result of driving point 22 corresponding to distance $r_1$, is shown as graph 40. The response, as a result of driving point 24 corresponding to distance $r_2$, is shown as graph 42. The combined effect of this staggered tuning is shown as the dotted response plot 44. This, quite obviously, provides a wider bandwidth than that which is provided by a single driving point.

The bandwidth of the antenna element shown in FIG. 2 is also enhanced by shaping of the substrate material. The tapered shape acts as an impedance transformer section between the impedance inside of the cavity and that outside of the cavity, which is free space. By means of impedance transformation, good impedance match is achieved between the interior and exterior regions of the cavity. Good impedance match in this antenna art means efficient radiation of energy from the antenna element to free space.

A prototype microstrip antenna element, as shown in FIGS. 1 and 2, has been constructed. The driven plate 12 and ground plane 14 were thin plates having thickness of around 0.040". The diameter of the plate 12 was 4.45" and the ground plane was approximately 2'×2'. The spacing between the plate 12 and ground plane 14, S=0.25". The substrate material used was teflon glass in a conical shape with a base diameter equal to 4.45". The dielectric constant of teflon glass is approximately 2.5. The two driving points 22, 24 were separated from the grounding pin 20 by $r_1$=0.6" and $r_2$=0.8", respectively.

Operating at L-band (1 gigahertz), the antenna element exhibits a "VSWR 2:1" bandwidth of approximately 10%. This compares very favorably with dipole and slot radiator elements.

In summary, an improved microstrip antenna has been disclosed.

While the preferred embodiment of the invention has been described in detail, it should be apparent that many modifications and variations thereto are possible, all of which fall within the true spirit and scope of the invention.

I claim:

1. A microstrip antenna comprising:

a conductive element ground plane;

a predetermined dimension conductive plate predeterminedly spaced from said ground plane;

a predeterminedly tapered dielectric element positioned between the conductive plate and the ground plane;

an electrical interconnection point predeterminedly located between the conductive plate and the ground plane; and a pair of driving point connections to the conductive plate, each driving point being at a predetermined distance $r_1$, $r_2$, respectively, from said interconnection point.

2. The microstrip antenna of claim 1 wherein the conductive plate is circular in shape and the tapered dielectric is conical in shape having the longitudinal axis thereof positioned opposite the center of the circular shape.

3. The microstrip antenna of claim 2 wherein the interconnection point extends from the center of the conductive plate, through the longitudinal axis of the dielectric cone to the ground plane.

4. The microstrip antenna of claim 3 wherein each driving point is located on the same diameter of :said circular plate, on opposite sides of the center thereof, with the distances $r_1$ and $r_2$ selected to form tuned circuits below and above, respectively, a desired center frequency.

5. The microstrip antenna of any one of claims 1–4 in combination with a 180° hybrid, the 180° hybrid adapted to receive a signal from a signal source and split said signal into two, 180° out of phase signals, each of said signals being fed to one of said driving point connections.

* * * * *